United States Patent [19]

Pelcin

[11] 4,134,281

[45] Jan. 16, 1979

[54] CAM-TYPE DOOR LOCK WITH RECESSED HANDLE

[75] Inventor: Albert L. Pelcin, Aurora, Ohio

[73] Assignee: The Eastern Company, Cleveland, Ohio

[21] Appl. No.: 822,520

[22] Filed: Aug. 8, 1977

[51] Int. Cl.[2] ..... E05B 13/10

[52] U.S. Cl. ..... 70/208; 292/210; 292/218; 292/228; 292/DIG. 31

[58] Field of Search ..... 70/208–212, 70/215; 292/54, 52, 108, 118, 154, 200, 205, 208, 210, 211, 217, 218, 228, DIG. 30–32

[56] References Cited

U.S. PATENT DOCUMENTS

| | | | |
|---|---|---|---|
| 2,592,647 | 4/1952 | Black | 292/218 |
| 2,601,577 | 6/1952 | Whitmore | 292/228 X |
| 3,209,563 | 10/1965 | Pelcin | 70/208 X |
| 3,958,821 | 5/1976 | Scalera | 70/208 X |

FOREIGN PATENT DOCUMENTS

| | | | |
|---|---|---|---|
| 2213790 | 9/1973 | Fed. Rep. of Germany | 292/108 |

*Primary Examiner*—Roy D. Frazier
*Assistant Examiner*—William E. Lyddane
*Attorney, Agent, or Firm*—David A. Burge Co.

[57] ABSTRACT

A door lock, particularly well suited for releasably retaining a pivotally mounted truck door in a closed position, includes a shaft and its operating means mounted on the door, and a pair of keeper members mounted on the door frame. A pair of cam members are secured to opposite end regions of the shaft. The shaft has a central portion which projects through openings formed in opposite sides of a pan-shaped housing. A handle is secured to the central portion for rotating the shaft to bring the cam members into and out of latching engagement with the keeper members. The handle is moveable between a nested position wherein the handle is nested within a recess defined by the pan-shaped housing, and a projecting position wherein the handle projects forwardly from the recess. A latch mechanism is carried by the housing and includes a latch member mounted for pivotal movement between latched and unlatched positions. The latch member is operable to engage and releasably restrain the handle from moving out of its nested position. A key-operated lock cylinder is carried by the handle, and has a lock member which is movable between locked and unlocked positions as a key is turned in the lock cylinder. The lock member is operable to retain the latch member in its latched position when the handle is in its nested position. A lock member reinforcing structure is provided which not only supports and rigidifies the lock member when the lock member is in its locked position, but also cooperates with the lock member to provide a back-up, secondary locking action which will keep the lock locked even if the primary locking system is disabled, as by tampering. A handle return spring is preferably interposed between the shaft and the housing to bias the handle toward its nested position.

11 Claims, 8 Drawing Figures

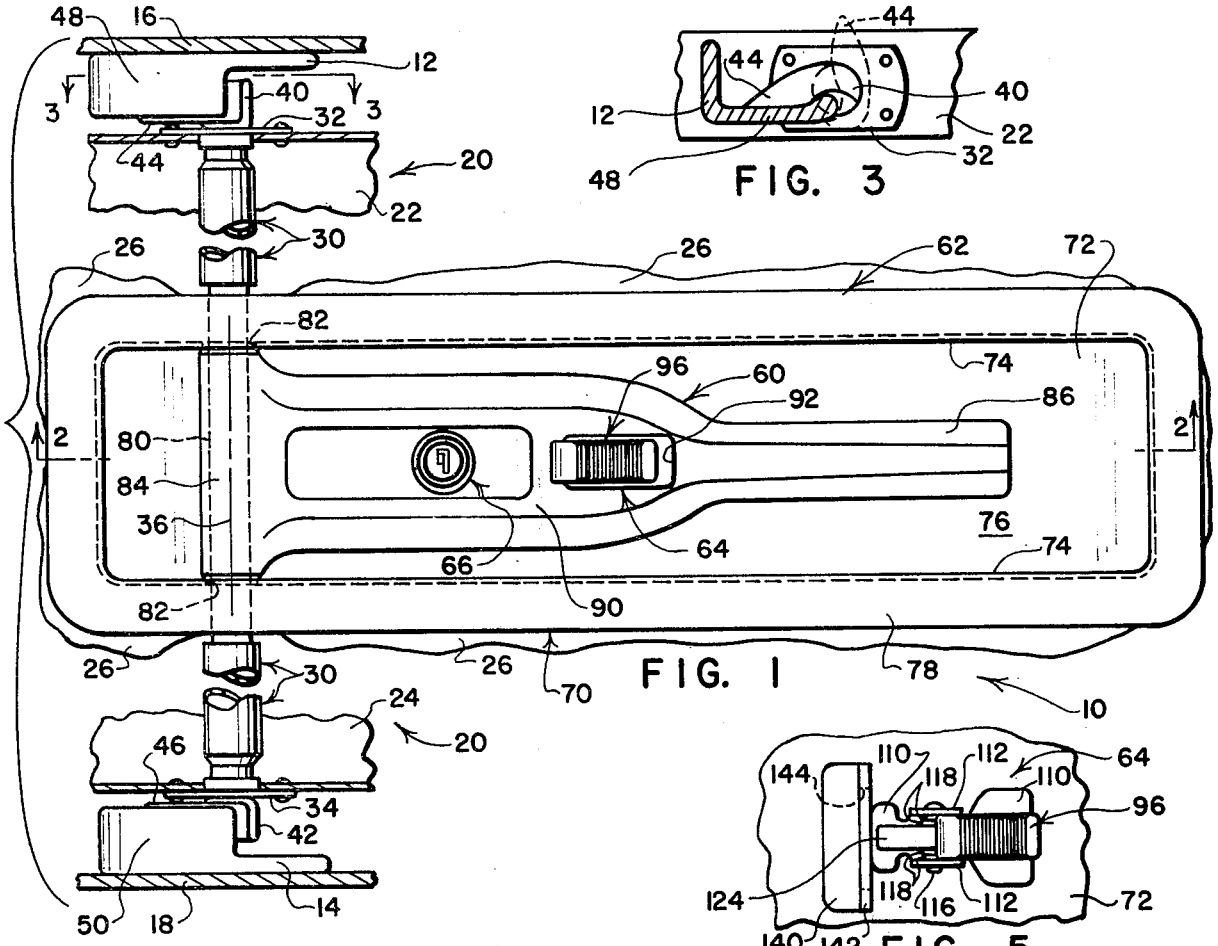
FIG. 1
FIG. 3
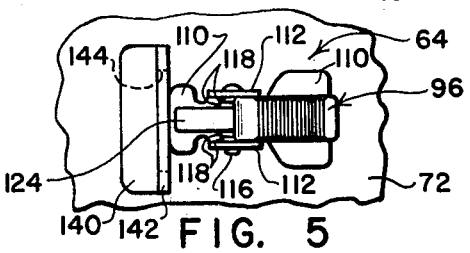
FIG. 5
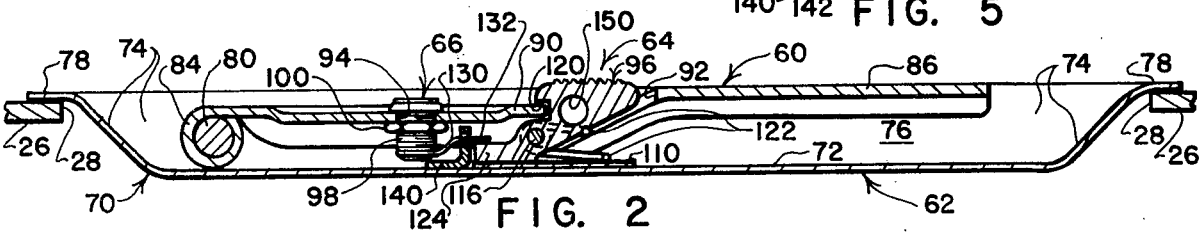
FIG. 2
FIG. 6
FIG. 7
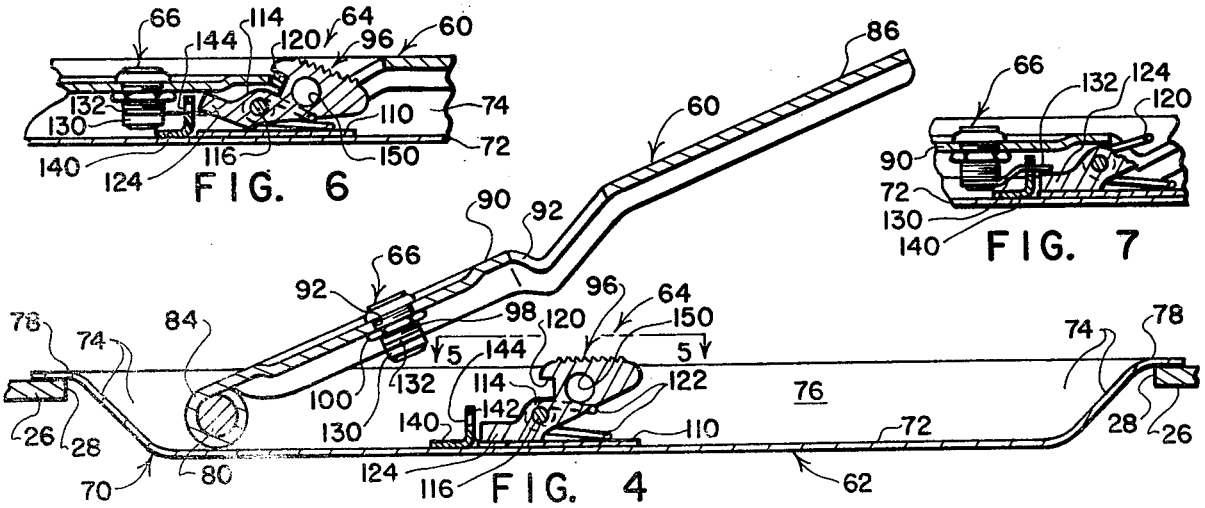
FIG. 4

CAM-TYPE DOOR LOCK WITH RECESSED HANDLE

BACKGROUND OF THE INVENTION

1. Field of the Invention

The present invention relates generally to door locks of the type used on large doors of moving vans and the like, and, more particularly, to a door lock including a lockable recessed handle.

2. Prior Art

Door locks of the type including an elongate shaft pivotally supported on a pivoted door and carrying cam members on opposite end regions of the shaft for releasably engaging keeper members carried on opposite sides of a door frame to retain the door in a closed position, are well known. Locks of this type are typically provided with a handle connected to the shaft for rotating the shaft to bring the cam members into and out of engagement with the keeper members. Such locks are commonly used on semi-trailer truck doors and the like.

Locks of the type described having a pan-shaped housing in which the handle is nested when the lock is locked, are also well known. Such locks are frequently used on the side doors of moving vans and the like where it is desired that the handle not project beyond the outer surface of the door when the door is locked. One such lock is sold by Eberhard Manufacturing Company Cleveland, Oh. 44136, under the model designation 5661.

It is known to provide the handles of locks such as Eberhard model 5661 with a key-operated lock cylinder to retain the operating handle in a locked position. A drawback of proposals for providing a key-operated cylinder in such a lock is that components of the resulting assembly can be bent, broken, or otherwise damaged by the application of undue force, as during tampering, whereby the locking action of the assembly is readily overcome. Moreover, previous proposals in no way provide a back-up or secondary locking system which will operate to maintain the lock locked even if the locking action of the primary locking system has been overcome.

It is also known to provide the handles of locks such as Eberhard model 5661 with a handle return spring interposed between the pan-shaped housing and the handle itself. A drawback of previous proposals has been that the spring rubs against the handle and causes the protective, corrosion resistant finish applied to the handle to be worn away quite rapidly.

SUMMARY OF THE INVENTION

The present invention overcomes the foregoing and other drawbacks of prior art proposals by providing a novel and improved, cam-type door lock having a recessed handle and an improved locking system for retaining the handle in its nested position.

In the preferred practice of the present invention, a door lock of the type used to lock a pivotally mounted door in a closed position includes a pair of keeper members adapted to be secured to a door frame near two opposite edges of the door opening defined by the door frame. The edges selected to support the keeper members are those which extend transversely to an axis about which a door is mounted for pivotal movement relative to the door frame. The door lock further includes an elongate shaft structure which is adapted to be secured to the door with the longitudinal axis of the shaft being spaced from and extending substantially parallel to the pivot axis of the door. Two cam members are each secured to opposite end regions of the shaft and are rotatable with the shaft to selectively releasably engage the keeper members to hold the door in a closed position.

A housing is provided for mounting in an opening formed in the door. The housing has sidewalls and a backwall which cooperate to define a forwardly facing recess, and has a pair of aligned openings formed in opposite sidewall portions. The shaft structure has a central portion which extends through the openings and through the recess. An elongate handle has one end portion secured to the central portion of the shaft structure. The handle is rotatable with the shaft structure relative to the housing between a nested position wherein the handle is nested within the recess, and a projecting position wherein the other end portion of the handle projects forwardly from the recess.

A latch mechanism is carried by the housing and includes a latch member mounted for pivotal movement between latched and unlatched positions. The latch member is operable to engage and releasably retain the handle in its nested position when the latch member is in its latched position and the handle is in its nested position. A key-operated lock cylinder is carried by the handle. A lock member is moveable by the lock cylinder between locked and unlocked positions as a key is turned in the lock cylinder. The lock member is operable to retain the latch member in its latched position when the handle is in its nested position.

A lock member reinforcing structure is carried by the housing and defines a formation which receives the lock member when the handle is in its nested position, and when the lock member is in its locked position. The lock member reinforcing structure not only operates to support and rigidify the lock member, thereby preventing the lock member from being bent, broken, or otherwise damaged by the application of undue force to the latch member, but also cooperates with the lock member to define a back-up or secondary lock which will retain the handle in its nested, locked position even if the latch member is broken by an application of undue force.

The latch member preferably has a projection which pivots forwardly as the latch member is moved from its latched position toward its unlatched position. The lock member preferably has an end portion which overlies the projection to prevent movement of the latch member toward its unlatched position when the handle is in its nested position, when the latch member is in its latched position, and when the lock member is in its locked position. The receiving formation on the lock member reinforcing structure preferably takes the form of a slot which receives the lock member end portion at a location adjacent to the latch member projection to prevent the transfer of excessive moment forces along the lock member in response to an application of undue force on the latch member.

Another feature of the preferred practice of the present invention lies in its provision of a handle return spring interposed between the pan-shaped housing and the shaft structure. Unlike prior proposals wherein a handle return spring has been located within the recess defined by the pan-shaped housing, the present invention provides a torsion coil handle return spring located out of sight and at a protected position behind the front face of the housing. Moreover, unlike prior proposals, the handle return spring does not operate directly on the handle itself, and therefore does not cause the protective finish on the handle to be worn away.

As will be apparent from the foregoing summary, it is an object of the present invention to provide a novel and improved door lock.

It is the further object of the present invention to provide a door lock of the type described with a simple and inexpensive means to render its elements more resistant to tampering.

These and other objects and a fuller understanding of the invention described in the present application may be had by referring to the following description and claims taken in conjunction with the accompanying drawing.

BRIEF DESCRIPTION OF THE DRAWING

FIG. 1 is a foreshortened side elevational view of a door lock embodying the preferred practice of the present invention;

FIG. 2 is a sectional view as seen from a plane indicated by a line 2—2 in FIG. 1;

FIG. 3 is a sectional view as seen from a plane indicated by a line 3—3 in FIG. 1, and showing in phantom a cam member moved to its door unsecured position;

FIG. 4 is a sectional view similar to FIG. 2 showing the handle of the door lock moved out of its nested position;

FIG. 5 is a top plan view of portions of the door lock as seen from a plane indicated by a line 5—5 in FIG. 4;

FIG. 6 is a sectional view similar to FIG. 2 showing a portion of the door lock with the latch member moved to its unlatched position;

FIG. 7 is a sectional view similar to FIG. 2 showing a portion of the door lock with the latch member having a portion broken off, as may occur if the lock is tampered with while locked.

DESCRIPTION OF THE PREFERRED EMBODIMENT

Figure 8:
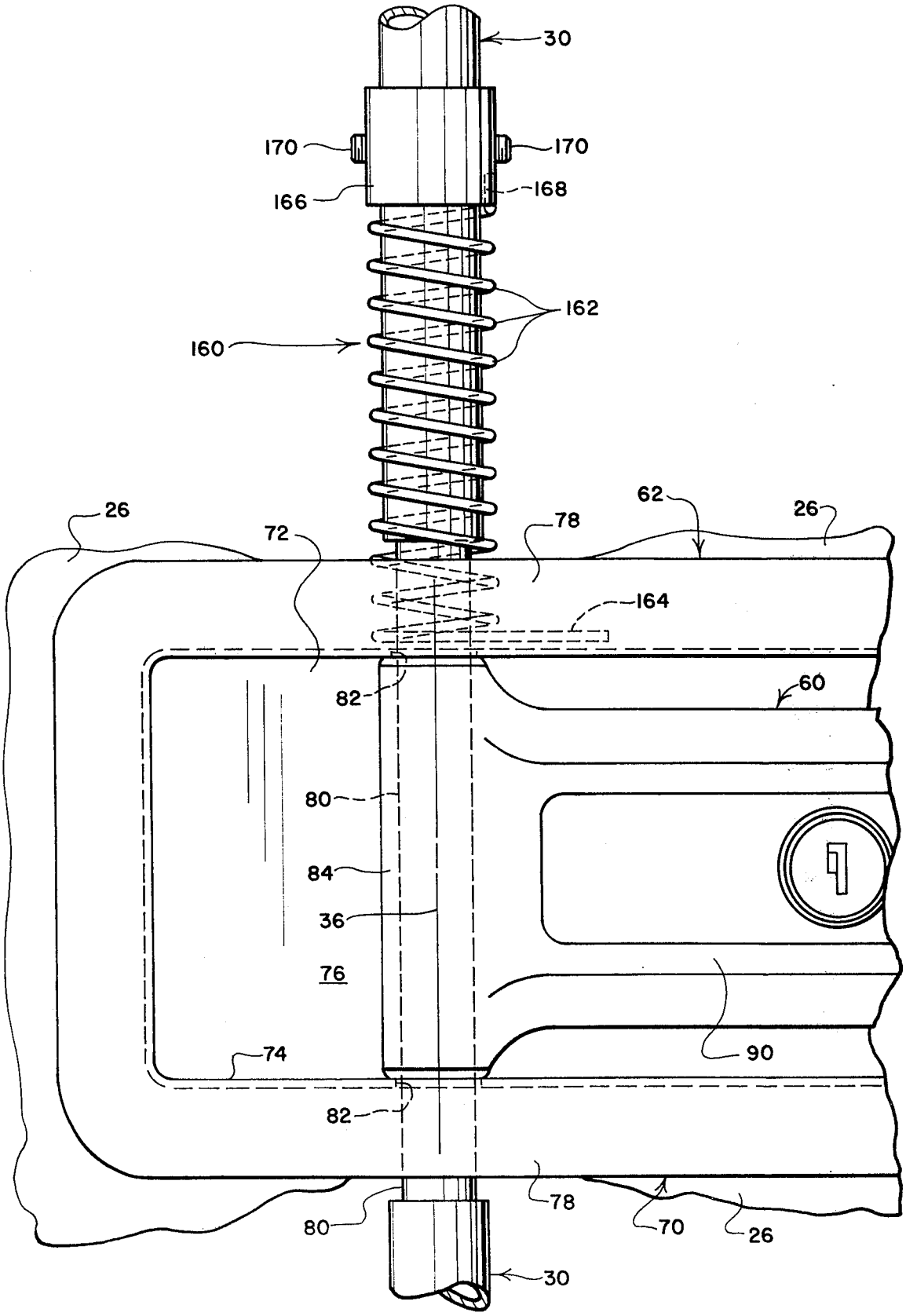
FIG. 8 is an enlarged side elevational view similar to FIG. 1 illustrating how a handle return spring is preferably incorporated in the lock of FIG. 1.

Referring to FIG. 1, a door lock embodying the preferred practice of the present invention is indicated generally by the numeral 10. The door lock 10 includes a pair of keeper members 12, 14, which are secured to top and bottom parts of a door frame, indicated by numerals 16, 18. The door lock 10 additionally includes an assembly 20 which is mounted on a pivoted door. Upper, lower and intermediate portions of the pivoted door are indicated by the numerals 22, 24, 26.

The assembly 20 includes an elongate shaft 30. The shaft 30 is preferably formed as an assembly of several inter-fitting cylindrical and/or tubular parts, but may be formed in one piece, if desired. A pair of brackets 32, 34 journal the shaft 30 for rotation about an axis indicated by the numeral 36. The door on which the assembly 20 is mounted is pivoted about an axis, not shown, which pivot axis is spaced from and extends parallel to the axis 36. The pivot axis of the door would normally be located to the right of the assembly 20 in the embodiment shown in FIG. 1.

The assembly 20 additionally includes a pair of cam members 40, 42 which are secured to opposite end regions of the shaft 30. The cam members 40, 42 are mirror images of each other and include transversely extending arm portions 44, 46. The keeper members 12, 14 are mirror images of each other and include projecting portions 48, 50 which project toward the door portions 22, 24. The cam members 40, 42 are rotatable with the shaft 30 between a door unsecured position, shown in phantom in FIG. 3, and a door secured position, shown in solid lines in FIGS. 1 and 3. When the cam members 40, 42 are in the door unsecured position, their arm portions 44, 46 will move freely past the projecting portions 48, 50 when the door is pivoted about its pivot axis. When the cam members 40, 42 are in the door secured position, and when the door is in its closed position, the arm portions 44, 46 extend behind the projecting portions 48, 50 to retain the door in its closed position.

The assembly 20 further includes a handle 60 which is operable to rotate the shaft 30 to position the cam members 40, 42, and a housing assembly 62 within which the handle 60 may be nested. A latch assembly 64 is provided to releasably retain the handle 60 in its nested position, and a key-operated lock cylinder 66 is carried by the handle 60 for selectively locking the handle 60 in its nested position.

Referring to FIGS. 1 and 2, the housing assembly 62 includes an elongate, pan-shaped housing 70 stamped from sheet metal. The housing 70 has a backwall 72 and sidewalls 74 which cooperate to define a forwardly facing recess 76. The housing 70 has a rim 78 which extends peripherally around its forward face. The housing 70 is positioned within an opening 28 formed in the door portion 26, and has its rim 78 overlying such parts of the door portion 26 as define the opening 28. The housing 70 is secured to the door portion 26 as by welding or by some other suitable conventional fastening system.

The shaft 30 has a central portion 80 which extends through aligned openings 82 formed in opposite portions of the sidewalls 74, and through the forwardly facing recess 76. The handle 60 has an end portion 84 which is secured to the central portion 80, and an opposite end portion 86 of reduced cross-section which is configured to be gripped conveniently by the fingers of one's hand.

The handle 60 has an intermediate portion 90, through which a slot 92 and a hole 94 are formed. The latch assembly 64 includes a latch member 96 which projects through the slot 92 when the handle is in its nested position. The lock cylinder 66 has a threaded shank 98 which extends through the hole 94. A nut 100, or other suitable fastener secures the lock cylinder 66 to the handle 60.

Referring to FIGS. 2, 4, 5 and 6, the latch assembly 64 includes a mounting bracket 110 which is secured to the backwall 72 as by spot welding. The bracket 110 has a pair of forwardly extending arms 112 which extend alongside a central portion 114 of the latch member 96. A pin 116 extends through aligned holes formed in the arms and in the portion 112, 114 to pivotally mount the latch member 96 on the bracket 110. A torsion coil spring has coils 118 which wrap around the pin 116 at locations on opposite sides of the central portion 114, and has end portions 122 which bear against the bracket 110 and the latch member 96 to bias the latch member 96 counter-clockwise, as viewed in FIGS. 2, 4 and 6.

The latch member 96 has a notch 120 which is configured to engage the central handle portion 90 adjacent one edge of the slot 92 when the handle 60 is in its nested position. When the latch member notch 120 is engaging the handle portion 90, as shown in FIG. 2, the latch member 96 is in its latched position and operates to retain the handle 60 in its nested position. The torsion spring coil 118 are operative to bias the latch member 96 toward, and to retain the latch member 96 in, its latched position.

The latch member 96 may be pivoted about the axis of the pin 116 between its latched position and an unlatched position, shown in FIG. 6. When the latch member 96 is in its unlatched position, the handle 60 may be pivoted about the shaft axis 36 between its nested position, as shown in FIG. 2, and projecting positions, one of which is illustrated in FIG. 4.

The latch member 96 has a foot 124 which projects leftwardly, as viewed in FIGS. 2, 4, 5 and 6, toward the lock cylinder 66. When the latch member 96 is in its latched position, the foot 124 abuts the bracket 110. When the latch member 96 pivots away from its latched position, the foot 124 pivots forwardly, as shown in FIG. 6.

The lock cylinder 66 carries a lock member 130 which is rotatable between locked and unlocked positions when a key is turned in the lock cylinder 66. The locked position of the lock member is shown in FIG. 2, and the unlocked position in FIGS. 4 and 6. The lock member 130 has an end portion 132 which overlies the foot 124 when in its locked position, and which is spaced to the left of the foot 124, as viewed in FIG. 6, when in its unlocked position.

The locking engagement established between the locking member 130 and the latch member foot 124, and between the latch member notch 120 and the handle portion 90, provides a primary locking system which will, in normal use, effectively retain the handle 60 in a nested, locked position. Such a primary locking system, however, suffers the drawback that, if a person seeking unauthorized entry tampers with the lock 10 by subjecting the latch member portion 96 to excessive rearward pressure, tending to pivot it clockwise about the pin 116, as viewed in FIGS. 2, 4 and 6, damage may result to the lock components causing them to cease their locking function. One type of damage which may occur is for the locking member 130 to be bent forwardly to a degree which will permit the latch member 96 to pivot to a position where the notch 120 will no longer engage the handle portion 90. Another type of damage which may occur is that the latch member 96 may be broken by the application of excessive force whereby its notched portion no longer engages the handle 90 and permits the handle 60 to be pivoted out of its nested position.

In accordance with a particularly advantageous feature of the present invention, a lock member reinforcing structure 140 is mounted on the backwall 72 as by spot welding or by some other suitable conventional fastening system. The reinforcing structure 140 preferably takes the form of an L-shaped bracket having an upstanding leg 142. The reinforcing structure 140 has a lock member receiving formation, preferably taking the form of a slot 144 provided in the upstanding leg 142. The slot 144 is positioned so that, when the lock member 130 is rotated to move its end portion 132 into overlying engagement with the foot 124, the end portion 132 will project though the slot 144. When the end portion 132 is projecting through the slot 144, as shown in FIG. 2, the reinforcing structure 140 operates to support and rigidify the lock member 130 so that, in the event that excessive inward force is applied to the latch member 64, the lock member 130 will not be bent out of shape to a degree which will permit the latch member notch 120 to disengage the handle portion 90. In this way, the reinforcing structure 140 operates to reduce the possibility of lock damage due to the application of undue force, and substantially reduces the likelihood that the primary locking system may fail during tampering.

A significant additional feature of the reinforcing structure 140 is that it cooperates with the lock member 130 to establish a back-up or secondary locking system which will be operable to maintain the handle 60 in its nested, locked position even in the event of failure of the latch member 96 to perform its primary locking function. As is illustrated in FIG. 7, if an excessive amount of inward force has been applied to the latch member 96, sufficient to break off the upper portion of the latch member 96, the interfitting engagement which is still established between the lock member 130 and the reinforcing structure 140 will be operable to maintain the handle 90 in its nested, locked position. It will still be necessary to utilize a key inserted in the lock cylinder 66 to rotate the lock member 130 to its unlocked position before the handle 60 can be moved out of its nested, locked position.

The latch member 96 is preferably formed using powder metallurgy techniques to provide a relatively rigid, smooth-finished component at relatively low cost. A hole 150 is provided through the upper portion of the latch member 96 to permit the hasp of a padlock to be inserted therethrough to provide an additional, third, locking action which will further enhance the secure locking of the handle 60 in its nested position.

Referring to FIG. 8, in preferred practice, a handle return spring 160 is interposed between the shaft 30 and the pan-shaped housing 70 to bias the handle 60 toward its nested position. The spring 160 has torsion coils 162 which wrap around a portion of the shaft 30, and an elongate lower end 164 portion which engages the back face of the housing rim 78. A collar 166 drivingly engages an upper end portion 168 of the spring 160. A pair of set screws 170 drivingly connect the collar 168 to the shaft 30.

A feature of the biasing action of the handle return spring 160 is that it prevents the handle 60 from being accidentally left in a position where it can do damage to the side wall of a truck on which the door is mounted. If, for example, the handle 60 were left in a fully open position wherein the handle end 96 extends in a plane perpendicular to the plane of the door, when the door is opened, the handle end 86 may impact the side wall of the truck, and may even puncture the side wall. The biasing action of the spring 160 will prevent the handle 60 from remaining in its fully open position once it has been released by an operator. The biasing action of the handle return spring 160 need not be so strong as to cause the handle 60 to assume its nested position when released, although a biasing strength of this magnitude may be desired.

By interposing the handle return spring 160 between the housing 70 and the shaft 30, rather than between a housing and a handle, as has been done in accordance with prior proposals, several advantages obtain. The spring 160 is concealed from view and is protected from exposure to road salts and the like which may splash on exposed parts of the lock 10. The spring 160 may be easily installed on the shaft 30, thereby minimizing assembly problems. Moreover, the spring 160 does not act directly against surface portions of the handle and therefore does not cause the protective corrosion-resistant finish on the handle to be worn away.

As will be apparent from the foregoing description, the present invention provides a novel and improved door lock assembly having latch and locking components for retaining a recessed handle in its nested, locked position, with primary and back-up locking systems which are well adapted to withstand an application of undue force. The simplicity of the system is enhanced by the use of a single reinforcing structure of elemental configuration which not only supports and rigidifies the lock components but also enhances their operation by providing a back-up locking action which will retain the handle in a locked position in the event the primary locking system is disabled.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed:

1. A door lock of the type used to lock a pivotally mounted door in a closed position, comprising:

(a) two keeper members adapted to be secured to a door frame near two opposite edges of a door opening defined by the door frame, which edges extend transversely to an axis about which a door is mounted for pivotal movement relative to the door frame;

(b) an elongate shaft structure adapted to be secured to the pivoted door with its longitudinal axis spaced from and extending susbtantially parallel to the pivot axis of the door;

(c) two cam members each being secured to opposite end regions of the shaft and being cooperable with the keeper members for securing the door in a closed position;

(d) a housing adapted to be mounted in an opening formed in the door, the housing having sidewalls and a backwall which cooperate to define a forwardly facing recess, and having a pair of aligned openings formed in opposite side wall portions;

(e) the shaft structure having a portion which extends through the openings and through the recess;

(f) an elongate handle having one end portion secured to the shaft portion and being pivotal with the shaft structure relative to the housing between a nested position wherein the handle is nested within the recess, and a projecting position wherein the other end portion of the handle projects forwardly from the recess;

(g) a latch mechanism carried by the housing, the latch mechanism including a latch member movable between latched and unlatched positions, the latch member being operable to engage and releasably retain the handle in its nested position when the latch member is in its latched position and the handle is in its nested position;

(h) a key-operated lock cylinder carried by the handle for movement therewith;

(i) a lock member operated by the lock cylinder and being movable between locked and unlocked positions as a key is turned in the lock cylinder, the lock member being operable to retain the latch member in its latched position when the handle is in its nested position and when the latch member is in its latched position, whereby a primary locking system operable to retain the handle in its nested position is provided; and (j) lock member reinforcing means carried by the housing and defining a formation which receives the lock member for supporting and rigidifying the lock member and for establishing a secondary locking system operable to retain the handle in its nested position when the lock member is in its locked position.

2. The door lock of claim 1 wherein the lock member reinforcing means includes a forwardly projecting structure secured to the backwall, and the lock member receiving formation includes a slot formed in the forwardly projecting structure, the lock member being operable to project through the slot when the handle is in its nested position and when the lock member is in its locked position.

3. The door lock of claim 1 wherein the latch member is formed from a powder metallurgy technique and has a projecting arm which lies behind the lock member when the handle is in its nested position, when the latch member is in its latched position, and when the lock member is in its locked position, the latch member additionally having a hole formed therethrough for receiving a padlock hasp whereby a padlock can be locked in place on the latch member to further secure the handle in its nested position.

4. The door lock of claim 1 wherein the latch member has a projection which pivots forwardly as the latch member is moved from its latched position toward its unlatched position, and the lock member has an end portion which overlies the projection to prevent movement of the latch member toward its unlatched position when the handle is in its nested position, when the latch member is in its latched position, and when the lock member is in its locked position.

5. The door lock of claim 4 wherein the lock member reinforcing means receives the lock member end portion at a location adjacent the projection.

6. The door lock of claim 1 additionally including handle biasing means interposed between the housing and the shaft structure for biasing the handle toward its nested position.

7. The door lock of claim 6 wherein:

(a) the handle biasing means includes a torsion coil spring having coils wrapped around the shaft structure at a location not within the recess;

(b) one end portion of the torsion coil spring engages a rearwardly facing surface of the housing; and (c) the other end portion of the torsion coil spring is drivingly connectd to the shaft structure.

8. A door lock of the type used to lock a pivotally mounted door in a closed position, comprising;

(a) two keeper members adapted to be secured to a door frame near top and bottom edges of a door opening defined by the door frame, the door being pivotally secured to the door frame about a substantially vertical axis for pivotal movement relative to the door frame;

(b) an elongate shaft structure adapted to be secured to the pivoted door with its longitudinal axis spaced from and extending substantially parallel to the pivot axis of the doors;

(c) two cam members, each being secured to opposite end regions of the shaft and being cooperable with the keeper members for securing the door in a closed position;

(d) an elongate, pan-shaped housing adapted to be mounted in an opening formed in the door, the housing having side walls and a back wall which cooperate to define a forwardly facing recess, and having a pair of aligned openings formed in opposite side wall portions;

(e) the shaft structure having a central portion which extends through the openings and through the recess;

(f) an elongate handle having one end portion secured to the central portion and being pivotal with the shaft structure relative to the housing between a nested position wherein the handle is nested within the recess, and a projecting position wherein the other end portion of the handle projects forwardly from the recess;

(g) a latch mechanism carried by the housing, the latch mechanism including a latch member movable between latched and unlatched positions, and biasing means biasing the latch member toward its latched position, the latch member being operable to engage and releasably retain the handle in its nested position when the latch member is in its latched position and the handle is in its nested position;

(h) the latch member having a projection which pivots forwardly as the latch member is moved from its latched position toward its unlatched position;

(i) a key-operated lock cylinder carried by the handle for movement therewith and being positioned by the handle in close proximity to the latch member projection when the handle is in its nested position;

(j) a lock member carried by the lock cylinder and being rotatably movable therewith between locked and unlocked positions as the key is turned in the lock cylinder, the lock member having an end portion which overlies the latch member projection to prevent movement of the latch member out of its unlatched position when the handle is in its nested position, when the latch member is in its latched position, and when the lock member is in its locked position;

(k) lock member reinforcing means carried by the housing and defining a formation which receives the lock member for supporting and rigidifying the lock member when the handle is in its nested position and when the lock member is in its locked position; and, (l) the lock member and the lock member reinforcing means also being operable to retain the handle in its nested position when the lock member is received by the formation.

9. The door lock of claim 8 wherein the lock member reinforcing means includes a structure secured to the back wall of the housing and projecting forwardly therefrom, and the lock member receiving formation includes a slot formed in the forwardly projecting structure, the lock member being operable to project through the slot when the handle is in its nested position and the lock member is in its nested position.

10. The door lock of claim 8 additionally including handle biasing means interposed between the housing and the shaft structure for biasing the handle toward its nested position.

11. The door lock of claim 10 wherein:

(a) the handle biasing means includes a torsion coil spring having coils wrapped around the shaft structure at a location not within the recess;

(b) one end portion of the torsion coil spring engages a rearwardly facing surface of the housing; and (c) the other end portion of the torsion coil spring is drivingly connected to the shaft structure.

* * * * *